US010982671B2

(12) United States Patent
Hinners

(10) Patent No.: US 10,982,671 B2
(45) Date of Patent: Apr. 20, 2021

(54) ROTARY PISTON PUMP WITH A PISTON FORMED BY A PLURALITY OF PLATES FILLED WITH POLYMER MATERIAL

(71) Applicant: Hugo Vogelsang Maschinenbau GmbH, Essen (DE)

(72) Inventor: Thomas Hinners, Löningen (DE)

(73) Assignee: HUGO VOGELSANG MASCHINENBAU GMBH, Essen (DE)

( * ) Notice: Subject to any disclaimer, the term of this patent is extended or adjusted under 35 U.S.C. 154(b) by 219 days.

(21) Appl. No.: 16/073,520

(22) PCT Filed: Jan. 27, 2017

(86) PCT No.: PCT/EP2017/051853
§ 371 (c)(1),
(2) Date: Jul. 27, 2018

(87) PCT Pub. No.: WO2017/129794
PCT Pub. Date: Aug. 3, 2017

(65) Prior Publication Data

US 2019/0048872 A1 Feb. 14, 2019

(30) Foreign Application Priority Data

Jan. 28, 2016 (DE) ..... 202016100419.5

(51) Int. Cl.
*F04C 15/00* (2006.01)
*F04C 2/12* (2006.01)
(Continued)

(52) U.S. Cl.
CPC ..... *F04C 15/0015* (2013.01); *F04C 2/084* (2013.01); *F04C 2/126* (2013.01);
(Continued)

(58) Field of Classification Search
CPC ..... F04C 15/0015; F04C 15/0023; F04C 18/126; F04C 18/16; F04C 2230/23;
(Continued)

(56) References Cited

U.S. PATENT DOCUMENTS 2,362,106 A 11/1944 Ungar et al.
2,451,603 A * 10/1948 Barker ..... F04C 2/126 418/150

(Continued)

FOREIGN PATENT DOCUMENTS

CN 104870750 8/2015
DE 3007267 9/1981

(Continued)

OTHER PUBLICATIONS

Paul Tres, Designing Plastic Parts for Assembly (8th Edition), Haner Publishers, 2017, pp. 35-37 (Year: 2017).*

(Continued)

*Primary Examiner* — Mary Davis
(74) *Attorney, Agent, or Firm* — Price Heneveld LLP

(57) ABSTRACT

The invention relates to a rotary piston pump comprising a housing with a housing interior, an inlet opening, and an outlet opening; a first rotary piston which is mounted within the housing interior in a rotational manner about a first rotational axis; and a second rotary piston which is mounted within the housing interior in a rotational manner about a second rotational axis. The first rotary piston and the second rotary piston engage into each other in a region between the first and the second axis and displace liquid. The first rotary piston has a frame assembly which comprises multiple mutually spaced plates and is at least partly filled and enveloped with a polymer material.

28 Claims, 15 Drawing Sheets

(51) Int. Cl.

| | |
|---|---|
| ***F04C 2/16*** | (2006.01) |
| ***F04C 2/08*** | (2006.01) |
| ***F04C 18/12*** | (2006.01) |
| ***F04C 18/08*** | (2006.01) |
| ***F04C 18/16*** | (2006.01) |

(52) U.S. Cl.
CPC ..... *F04C 2/16* (2013.01); *F04C 15/0023* (2013.01); *F04C 18/084* (2013.01); *F04C 18/126* (2013.01); *F04C 18/16* (2013.01); *F04C 2230/23* (2013.01); *F04C 2240/20* (2013.01)

(58) Field of Classification Search
CPC ..... F04C 2240/20; F04C 2/084; F04C 2/126; F04C 2/16
See application file for complete search history.

(56) References Cited

U.S. PATENT DOCUMENTS

| | | | | |
|---|---|---|---|---|
| 3,918,838 | A | 11/1975 | Moody, Jr. et al. | |
| 4,913,629 | A * | 4/1990 | Gilfillan | F04C 2/084 417/309 |
| 5,290,150 | A | 3/1994 | Takahashi et al. | |
| 6,497,563 | B1 * | 12/2002 | Steffens | F04C 18/16 418/88 |
| 10,208,656 | B2 * | 2/2019 | Pryor | F04C 18/16 |
| 2008/0170958 | A1 | 7/2008 | Prior et al. | |
| 2011/0076174 | A1 * | 3/2011 | Kakiuchi | F04C 18/16 418/99 |

FOREIGN PATENT DOCUMENTS

| | | |
|---|---|---|
| EP | 0814267 | 12/1997 |
| EP | 1300592 | 4/2003 |
| EP | 2306027 | 4/2011 |
| GB | 2395532 | 5/2004 |
| GB | 2490517 | 11/2012 |
| WO | 8908798 | 9/1989 |
| WO | 2004053296 | 6/2004 |
| WO | 2014151057 | 9/2014 |
| WO | 2015184371 | 12/2015 |

OTHER PUBLICATIONS

Fang Changlin et al., "Hydraulic and Pneumatic Transmission and Control," China Machine Press, Edition 1, p. 45 (Jul. 2001).
Lu Zhaoda, "Basic Course of Fluid Machinery," Harbin Institute of Technology Press, Edition 1, p. 288 (Dec. 2003).
Meier-Peter et al., "Ship Engineering Technical Manual," Shanghai Jiaotong University Press, Edition 1, p. 365 (Nov. 2009).
Wang Xianfang, Chemical Pipelines and Instruments, China Textile Press, Ed. 1, p. 97 (China) (Mar. 31, 2015).

* cited by examiner

ROTARY PISTON PUMP WITH A PISTON FORMED BY A PLURALITY OF PLATES FILLED WITH POLYMER MATERIAL

CROSS REFERENCE TO FOREIGN PRIORITY DOCUMENT

The present application claims the benefit under 35 U.S.C. §§ 119(b), 119(e), 120, 121, 365(c), and/or 386(c) of PCT/EP2017/051853 filed Jan. 27, 2017, which claims priority to German Application DE 202016100419.5 filed Jan. 28, 2016.

FIELD OF THE INVENTION

The invention relates to a rotary piston pump, comprising a housing with a housing interior space, an inlet opening through which liquid can flow into the housing interior space, an outlet opening through which liquid can flow out of the housing interior space, a first rotary piston, which is mounted so as to rotate about a first axis of rotation within the housing interior space, and a second rotary piston, which is mounted so as to rotate about a second axis of rotation within the housing interior space, wherein the first rotary piston and the second rotary piston engage into one another, and displace liquid, in a region between the first and the second axis. A further aspect of the invention is a method for producing a rotary piston for a rotary piston pump of said type, and a rotary piston for a rotary piston pump of said type.

BACKGROUND OF THE INVENTION

Rotary piston pumps are conveying devices for fluids which are used substantially for liquids of low or high viscosity. Here, rotary piston pumps operate in accordance with the principle whereby two oppositely rotating rotary pistons rotate about two mutually spaced-apart, parallel axes and, in so doing, engage into one another such that in each case one rotary piston lobe of one rotary piston engages into a rotary piston depression between two rotary piston lobes of the other piston. In this way, the liquid in the central region between the two axes is displaced by the mutual engagement action and, in the two outer circumferential regions outside the two axes of rotation, is conveyed from the inlet to the outlet opening in conveying chambers which are formed by the rotary piston depressions when the two rotary piston lobes, or the rotary piston lobe tips thereof, situated to either side of said rotary piston depression seal against the housing wall.

Here, rotary piston pumps may be equipped with rotary pistons which have two, three or more rotary piston lobes.

In one specific application, rotary piston pumps are used to convey particle-laden liquids. A problem in the conveyance of particle-laden liquids is the high level of wear that is caused to various pump components. Rotary piston pumps are fundamentally better suited than other pump designs to conveying particle-laden liquids, but, here, are also subject to, in some cases, high levels of wear.

This wear is caused by particles which either become trapped between the rotary pistons or trapped between the outer ends of the rotary piston lobes and the housing wall and thereby cause indentations or grinding marks in the surfaces of the housing wall or of the rotary pistons.

According to the prior art, rotary pistons are produced from a metal and, here, are manufactured with such fit accuracy that efficient conveyance is possible with low leakage rates. It is known for rotary pistons to be equipped with a superficial rubber layer in order to counteract wear effects during the conveyance of particle-laden liquids. The effect on which this measure is based lies in the fact that the rotary pistons, owing to the rubber layer, are, to a limited extent, suitable for enabling particles that become trapped between the rotary pistons or between the rotary piston lobe and housing wall to penetrate, by way of brief elastic or plastic deformation, into their rubberized surface without suffering permanent or severe damage in the process. In this way, the formation of deep indentations, wear marks, and other wear effects can be prevented, and the wear characteristics of rotary piston pumps in the conveyance of particle-laden liquids can be improved.

Rotary pistons of such design, however, have various problematic effects. Firstly, during the operation of such rotary piston pumps, it has been observed that the rubber layer detaches and can break away from the rotary piston, particularly if liquids with sharp-edged or large particles are conveyed and these particles have penetrated multiple times into the rubber layer of the rotary piston. By means of such relatively small- or large-area instances of delamination of the rubber layer, it is firstly the case that the protective effect of the rubber layer is locally reduced or eliminated entirely, and secondly, the pump efficiency is reduced, because the desired sealing action between the rotary pistons and between rotary pistons and housing wall is no longer reliably achieved. Owing to the manufacturing-induced shrinkage of a rubber layer on a rotary piston, a high degree of precision and fit accuracy of the rotary pistons is achieved in particular with a thin rubber coating which exhibits shrinkage which is reliably manageable from a manufacturing aspect. It has, however, been observed that the problem of the delamination of the rubber layer can be positively influenced by increasing the thickness of the rubber layer. There is, therefore, an optimization problem in the sense that, although the wear resistance with respect to delamination effects can be increased by increasing the thickness of the rubber layer, this, however, simultaneously reduces the manageability of the manufacturing accuracy, and thus either the reject rate in the manufacture of rotary pistons is increased or the precision of the fit accuracy of rotary pistons is reduced, which results in a reduction in conveying efficiency.

SUMMARY OF THE INVENTION

The invention is based on the object of proposing, within this optimization problem, an improved rotary piston pump for conveying particle-laden liquids.

This object is achieved according to the invention by means of a rotary piston pump of the type described in the introduction, in the case of which the first rotary piston has a frame arrangement which comprises multiple, mutually spaced-apart plates, and the frame arrangement is at least partially filled and at least partially enveloped with a polymer material.

With the construction according to the invention of the rotary piston of the rotary piston pump, the problems in the prior art are overcome through the realization of a completely different internal construction of the rotary piston. Instead of a metallic core that is equipped with a rubber layer of greater or lesser thickness, the rotary piston is constructed by means of multiple, mutually spaced-apart plates as a frame arrangement. Said frame arrangement is at least partially enveloped and filled with a polymer material. The rotary piston designed according to the invention is, in particular, designed such that—aside from a central opening for receiving a drive shaft—said rotary piston has no air-filled cavities, that is to say is, in its interior, filled either with plate material or with polymer material. The plates are preferably arranged such that they are oriented with their surface perpendicular to the axis of rotation of the rotary pistons. The plates, therefore, define, in particular, the cross-sectional geometry of the rotary piston by having a corresponding inner contour and a corresponding outer contour. In this case, he inner contour defines the inner central opening of the rotary piston, by means of which the rotary piston is received on a drive shaft. Said inner recess is preferably designed for the transmission of a torque, for example, by virtue of said recess having a polygonal cross section geometry or being designed in some other form for a positively locking transmission of torque. It is particularly preferable for the plates to directly define the geometry of the inner central opening of the rotary pistons, that is to say, to not be coated with the polymer material in the region of said inner opening of the rotary piston in order to realize a defined angular position of the rotary piston with respect to the drive shaft, which is free from elastic influences of the polymer material. Alternatively, the rotary piston according to the invention may have a hub with an internally situated opening through which a drive shaft can be inserted or which can be connected fixedly in terms of torque to a drive shaft in some other way. In this case, the plates have an inner central opening by means of which they can be mounted onto the outer geometry of said hub and fastened preferably fixedly in terms of torque thereon. It is furthermore preferable for the plates to be completely coated with polymer material on the outer surface of the rotary piston, in order that, in the context of the contact with the housing wall or with the other rotary piston, there is no direct contact between the housing and the plates or between the plates themselves.

It is basically to be understood that the plates are preferably formed from a material that has a higher stiffness, that is to say, a lower elasticity, and a higher strength than the polymer material. The plates may preferably be produced from, or at least partially comprised of, a non-metal in order to reduce the weight of the piston.

With the rotary piston constructed in this way, it is firstly the case that a much more stable connection between the carrier material and the polymer material is achieved, by virtue of the carrier material being provided as a frame arrangement composed of multiple plates. The disbonding, observed by the inventor, proceeding from damaged points, of the boundary layer between the polymer material and the metallic core in the case of rotary pistons according to the prior art can no longer occur in the case of the construction of the rotary pistons according to the invention, because the boundary layer between the frame arrangement and the polymer material covers a much larger area and can furthermore be formed substantially with surfaces which are perpendicular to the axial direction. This surface orientation, in relation to radially outwardly directed circumferential boundary surfaces, is much less sensitive to such disbonding and delamination. An advantage of the rotary piston according to the invention is furthermore the expedient dimensional stabilization by means of the frame arrangement, which counteracts shrinkage of the polymer material during the course of the crosslinking thereof. Here, in the context of the invention, crosslinking is to be understood to mean a process in which molecules bond to one another through the formation of new chemical bonds, or change through the replacement of a first type of chemical bond with another type of chemical bond. In particular, such crosslinking is to be understood to mean polymerization or vulcanization.

Aside from the advantages that are sought according to the invention, it has furthermore been found that the rotary pistons designed according to the invention are of lower weight than rotary pistons of known types of construction, whereby the overall weight of a rotary piston pump according to the invention is reduced in relation to conventional rotary piston pumps. A further advantage is that the rotary pistons according to the invention are produced with less use of metallic material in favor of a greater fraction of the polymer material, whereby the production costs are reduced with regard to the material costs.

In a first preferred embodiment, provision is made whereby the multiple, mutually spaced-apart plates are oriented parallel to one another, and/or, in each case, whereby the spacing between two mutually spaced-apart adjacent plates is equal.

It is basically possible for two, three, four, or even more plates to be used for producing a rotary piston, and for the intermediate space between these plates to be correspondingly filled with polymer material. It is basically to be understood that the frame arrangement composed of the plates is preferably completely filled with polymer material and, preferably, the outer surface of the rotary piston is completely enveloped with polymer material, whereas the inner opening of the rotary piston, which serves for the torque-conducting transmission of force from a drive shaft to the rotary piston, is preferably not enveloped with polymer material. By means of the orientation of the plates with uniform spacings to one another, simplified production is achieved by means of systematically equal spacings of the plates to one another. The parallel orientation of the plates gives rise to a uniform layer thickness of the polymer material situated in between, and thus avoids distortion in the outer geometry of the rotary piston as a result of polymerization or vulcanization processes or other crosslinking effects.

In a further preferred embodiment, provision is made for a spacer element to be provided between the plates, which spacer element extends over a predetermined height above a plate plane and, at its end pointing away from the plate plane, is in contact with another plate, in particular, with an adjacent plate, wherein the spacer element is preferably produced by bending deformation of a part of the plate. The production of a rotary piston according to the invention may be performed, in particular, by virtue of multiple plates which form the frame arrangement of the rotary piston being positioned in a defined position relative to one another in a mold, and then the filling/envelopment with the polymer material being performed within said mold.

It is advantageous here if the spacing between the individual plates is defined by separate spacer elements or by means of the geometry of the plates themselves, for example, by virtue of a spacer element being formed on the plates or inserted between two plates. Said spacer elements perform the function of a spacing means between the plates. It is basically possible for a single spacer element between two plates to perform this function and to position the plates in a defined position relative to one another and with a defined spacing to one another. Here, it is additionally possible for a position of the plates relative to the axis of rotation of the rotary piston to be defined, for example, by means of corresponding positional support against the hub of the rotary piston. Instead of a unipartite spacer element, the function of the spacing and possible positioning of the plates may also be performed by means of a multi-part spacer element, for example, a spacer element which is composed of two, three, four, or more spacer element pieces which are inserted between two adjacent plates. In this case, at least three spacer element pieces are preferred, such that a defined angular position of the plates with respect to one another, in particular, a parallel orientation of the plates with respect to one another, is achieved by means of the multi-part spacer element. The number of spacer element pieces that form a spacer element between two plates may, in particular, correspond to the number of rotary lobes of the piston, such that, in the case of rotary pistons with two, three, four, five, or six lobes, use is correspondingly made of spacer elements which are made up of two, three, four, five, or six spacer element pieces, respectively. A spacer element may furthermore preferably be formed integrally on a plate, that is to say, formed in one piece with the plate.

Here, it is particularly preferable for the spacer element to be produced by bending deformation of a part of the plate. This is a preferred method of production for the spacer elements, which is particularly suitable in the case of cold-workable or hot-workable materials from which the plates are produced. Here, in particular, a web formed on one side on the plate may be bent so as to stand at an angle of approximately 90° with respect to the plate surface and thus constitute the spacer element. Likewise, a web section that is connected on both sides to the plate can, by deformation, be deformed out of the plate plane such that it rises above the plate plane in a V-shaped contour, for example, and constitutes the spacer element.

In a further preferred embodiment, provision is made for the plates to be sheets manufactured from a metallic material, and/or for the polymer material to be a resiliently elastic material. The production of the plates from a metallic material permits a particularly robust frame arrangement that can withstand the operating forces, in particular, the forces required for the transmission of torque from the drive shaft to the rotary piston. The provision of the plates from a metallic material in the form of sheets permits, in particular, inexpensive manufacture of the plates by virtue of the plates being punched out, or cut by laser, from a semifinished part material in the form of sheets, and the production of the spacer elements by cold working of a corresponding section, or corresponding multiple sections, of said sheets. The polymer material may, in particular, be a resiliently elastic material that tolerates the elastic indentation of particles without damage to the polymer material. These are to be understood, in particular, to be polymer materials based on natural rubber, which are produced by means of a vulcanization process, though other materials similar to such a rubber characteristic may be used for the rotary piston according to the invention.

It is yet further preferable for the polymer material to be formed by a prefabricated polymer component which, in a crosslinked state, is inserted through mutually aligned openings in the plates, and a polymer material fraction that is formed by flowable polymer material which, in a flowable state, at least partially envelops the plates and the prefabricated polymer component and is thereafter crosslinked so as to assume a solid state. In this embodiment, the polymer material is formed by two different fractions. The first fraction is a prefabricated, already crosslinked component which, after the assembly of the plates, is passed through corresponding openings in said plates. Said prefabricated polymer component is then enveloped with a second polymer material fraction and thereby fixed in its position relative to the plates. The two fractions form one coherent polymer structure. The advantage of the rotary piston formed in this way lies in the fact that, firstly, a large polymer material fraction in the rotary piston can be realized, and secondly, a situation is avoided in which the rotary piston is produced by crosslinking of a large polymer material fraction within the frame arrangement and thus exhibits a large amount of poorly predictable shrinkage. Instead, an already crosslinked polymer component is used to fill a major part of the volume within the frame arrangement with polymer material, and only a small volume fraction within the frame arrangement is then filled/enveloped with a flowable polymer material, which then crosslinks and, in the process, undergoes shrinkage. Here, it is particularly preferable if the prefabricated polymer component and the polymer material fraction are composed of the same polymer material, whereby a particularly good bond between the prefabricated polymer component and the polymer material fraction enveloping the former is achieved. It is furthermore to be understood that multiple prefabricated polymer components may also be used in one rotary piston. For example, it is preferable for the plates to have multiple openings distributed over the circumference, such that a plate has a cross-sectional geometry similar to a spoked wheel, for example, and the multiple cavities thereby formed between the spokes are filled by correspondingly contoured polymer components.

In a further preferred embodiment, provision is made whereby the mechanical connection between the polymer material and the plates is formed by adhesive bonding, by positive locking between openings in the plates, which openings are filled with polymer material, or by non-positively locking connection by means of clamping elements which clamp the plates and the polymer material together. There are basically three main mechanisms available for realizing, in the construction of the rotary piston according to the invention, a connection between the polymer material and the plates or the frame arrangement. An adhesive connection may be realized directly between the polymer material and the plates; in order to reinforce or generate such an adhesive bond, the frame arrangement may also, before the addition of the polymer material, be coated with a primer or an adhesive which differs from the polymer material. This adhesive bond may in particular correspond to the adhesive bond used in rubber-metal elements in the vibration damping sector between the rubber and the metal part of such rubber-metal elements. Furthermore, positive locking between openings in the plates and polymer material led through said openings may be achieved. Said openings in the plates may be provided intentionally for this purpose, for example, in the manner of the plate structure already discussed above in the form of a spoked wheel, though other structures, such as holed plate elements or the like, are possibly also advantageous for such a positive locking effect. Finally, it is also possible for a non-positively locking connection between plates and polymer material to be achieved, that is to say for adhesion to be effected which is achieved by means of a frictional force between the plates and the polymer material. The normal force required for this friction force can be achieved by clamping of the plates and of the polymer material, for example, by virtue of screws which are perpendicular to the plate plane being provided between the outer plates of the rotary piston, which screws press said two outer plates together in an axial direction. It is basically possible for a single one of these connecting mechanisms, or several of these connecting mechanisms simultaneously, to act so as to produce the connection between the plates and the polymer material.

It is yet further preferable if the second rotary piston has a frame arrangement which comprises multiple mutually spaced-apart plates, and the frame arrangement is at least partially filled and at least partially enveloped with a polymer material. In this embodiment, the second rotary piston, like the first rotary piston, is constructed with a frame arrangement composed of multiple plates and of a polymer material. It is basically to be understood that the first and the second rotary pistons of the rotary piston pump may be structurally identical, and the second rotary piston may also be designed correspondingly to the embodiments discussed above.

It is yet further preferable if the first and/or the second rotary pistons has/have an internally situated, non-circular opening which is formed by an opening, which is not filled with the polymer material, in the plates, and if the first and second rotary pistons, respectivelys is rotatably mounted by means of a first and second shaft, respectively, which shaft is arranged in said opening. Such a recess or opening in the rotary pistons makes it possible for the rotary pistons to be arranged in positively locking fashion on a shaft correspondingly congruent with respect to the opening, and to be set in rotation by means of said shaft. Alternatively, the plates may be fastened in positively locking fashion to a hub, which, in turn, is fastened to the shaft, for example in non-positively locking or positively locking fashion. The recess or opening is formed by corresponding recesses or openings in the plates of the frame arrangement, which consequently effect a transmission of the torque from the drive shaft to the frame arrangement. It is thus, for example, possible for a polygonal recess to be provided in the plates or the rotary pistons; what is particularly suitable is a hexagonal opening which interacts with a corresponding hexagonal shaft or hexagonal hub. Other embodiments for the positive locking are, however, basically also possible, for example, keyways in an otherwise circular recess, which keyways are, for the positive locking to a corresponding cylinder section of the shaft or hub, provided with a corresponding parallel key. It is basically preferable if the two rotary pistons are connected in torque-conducting fashion to a drive shaft and said drive shafts are synchronized by means of an external gearing, such that the two rotary pistons are driven independently of one another but synchronously. In other embodiments, it is, however, also possible for only one of the two rotary pistons to be coupled and driven in torque-conducting fashion by means of a shaft, and for the other rotary piston to be set in synchronous rotation by engagement with the former rotary piston, without the other rotary piston itself being driven by means of a shaft. Said other rotary piston consequently merely has to be rotatably mounted, such that, here, a circular recess without transmission of torque to the shaft is also possible.

In a further preferred embodiment, provision is made for the first and the second rotary piston to have at least two rotary piston lobes that extend in a helical line along the outer circumference of the rotary pistons, and for the plates to have a corresponding geometry with at least two rotary piston lobes, wherein all of the plates are geometrically identical, and the helical profile is realized by means of a non-circular, helically running outer contour of a drive shaft or hub that has a positively locking fit with a central recess of the plates, or the plates are divided into at least two sets which are pushed onto a shaft or hub with a rectilinear, non-circular outer contour, wherein the plates within a set have a corresponding geometry, and the plates of two different sets have a mutually different geometry, such that the angular position between a non-circular contour of a central opening and the rotary piston lobe differs between the plates of two different sets.

It is basically possible for the rotary piston lobes to extend along an axially oriented line that runs parallel to the axis of rotation of the rotary piston. Rotary piston pumps having such rectilinearly running rotary piston lobes typically exhibit a pulsation during conveying operation, which pulsations are caused owing to the defined conveyance in the conveying chambers that form between the rotary piston lobes and the housing wall. By contrast, the pulsation of the conveyance can be reduced or eliminated entirely if the rotary piston lobes extend along a helically twisted line. This design is suitable, in particular, for rotary pistons with more than two rotary piston lobes, that is to say, three-, four- or multi-lobe rotary pistons, because in the case of this design, the sealing of the chambers between the rotary piston lobes and the housing wall is reliably achieved. It is preferable if the contour of the rotary piston is predefined as far as into the rotary piston lobes by the frame arrangement. In this case, in this preferred embodiment, the frame arrangement must replicate or exhibit the helical profile of the rotary piston lobes. This can, according to the invention, be achieved by means of two alternative embodiments. Firstly, the plates that form the frame arrangement of a rotary piston may be geometrically identical. Since, however, the rotary piston lobe replicated in one plate must be offset with respect to that in the replication of the same rotary piston lobe in a plate adjacent thereto by a predefined angle which is calculated from the gradient of the helical line and the spacing of the two plates, the plates must in this case be arranged with an angular offset with respect to one another on the drive shaft. In the case of identical plates being used, this can be achieved by virtue of the outer contour of the drive shaft or hub likewise having a rotationally asymmetrical contour with a helical profile. Such a profile of the outer contour of the drive shaft or hub makes it possible for the plates of the frame arrangement to be of identical design and to be arranged with an angular offset with respect to one another in the rotary piston, such that said helical profile of the outer contour is correspondingly congruently replicated in the rotary piston. A consequence of this arrangement is a helical profile of the rotary piston lobes, wherein the gradient of the helical line of the rotary piston lobes corresponds to the gradient of the outer contour of the drive shaft or hub. An advantage of this embodiment is the use of identical plates, which permits the production thereof in an inexpensive mass production context.

As an alternative to this embodiment, it is also possible for two or more different sets of plates to be provided in order to produce the frame arrangement of a rotary piston in accordance with the design according to the invention. In the case of this embodiment, the drive shaft or hub is equipped with a non-circular outer contour, which is, however, of rectilinear form, that is to say, parallel to the longitudinal axis of the drive shaft, and consequently does not have a helical profile. Plates of different geometry are now pushed onto said drive shaft or hub, wherein said plates differ in that the angular positions of the rotary piston lobes in relation to the non-circular contour of the central recess of the plate differ from one another. This permits, for example, the following production process and approach for a rotary piston with helically running rotary piston lobes: the rotary piston is designed as a three-lobe rotary piston, that is to say, each plate has three rotary piston lobes that are offset with respect to one another by an angle of 120°. The first set of plates is equipped with a keyway in a central circular recess which is at an angular position of zero with respect to a rotary piston lobe. A second set of plates is produced that has an angular position of the keyway of 40° with respect to the rotary piston lobe. A third set of plates is produced that has an angular position of 80° between keyway and rotary piston lobe. The frame arrangement of this rotary piston may then be constructed by virtue of a plate of the first set, a plate of the second set, a plate of the third set, and then, in turn, a plate of the first set, followed by a plate of the second set, and a plate of the third set, in each case being arranged successively with respect to one another such that the keyways of the plates are in alignment with one another. This yields a helical line of the rotary piston lobes, which in this case is defined by a total of six plates. An advantage of this embodiment is the simple and inexpensive production of the drive shaft or hub, which can be designed as a conventional cylinder shaft or hollow hub with keyway in the outer circumferential surface or with a hexagonal outer surface.

A further aspect of the invention is a method for producing a rotary piston for a rotary piston pump, having the steps: forming a frame arrangement by providing multiple mutually spaced-apart plates, at least partially enveloping the plates with a polymer material in a flowable state, and producing a connection between the frame arrangement and the polymer material by crosslinking the polymer material.

The method is suitable for inexpensive production, avoiding a large fraction of metallic material for a rotary piston, while achieving high fit accuracy and expedient wear and delamination characteristics. As polymer material, use is made, in particular, of a resiliently elastic material, such as, for example, a rubber material based on natural rubber, which is changed into its mechanically solid form, and placed in adhesive connection with the frame arrangement, by vulcanization. The method may be refined by virtue of the plates being positioned parallel to one another by means of spacer elements formed on the plates.

It is yet further preferable if the plates are produced from sheet metal and if a spacer element is formed between two plates, for example, by virtue of one or three sections of the metal sheet being bent.

Finally, the method may be further refined by virtue of the polymer material being produced by prefabricating a polymer component by crosslinking of a first fraction of the polymer material before the formation of the frame arrangement, arranging the prefabricated polymer component in mutually aligned openings in the plates, and at least partially enveloping the plates and the polymer component with a second fraction of the polymer material in the state of a flowable polymer material, and crosslinking or hardening the second fraction of the polymer material such that it assumes a solid state.

A further aspect of the invention is a rotary piston for a rotary piston pump, which is distinguished by a frame arrangement that comprises multiple mutually spaced-apart plates, wherein the frame arrangement is at least partially filled and at least partially enveloped with a polymer material. Said rotary piston is firstly inexpensive and secondly exhibits high fit accuracy and is particularly resistant to abrasion, wear, and delamination of the polymer material from the frame arrangement. The rotary piston may, in particular, be further refined as has been described above with regard to a rotary piston that is used in a rotary piston pump according to the invention. Furthermore, the rotary piston may be refined by virtue of being produced in accordance with a method of the type described above.

BRIEF DESCRIPTION OF THE DRAWINGS

A preferred embodiment of the invention will be described on the basis of the appended figures, in which.

DETAILED DESCRIPTION OF THE PREFERRED EMBODIMENTS

Figure 1:
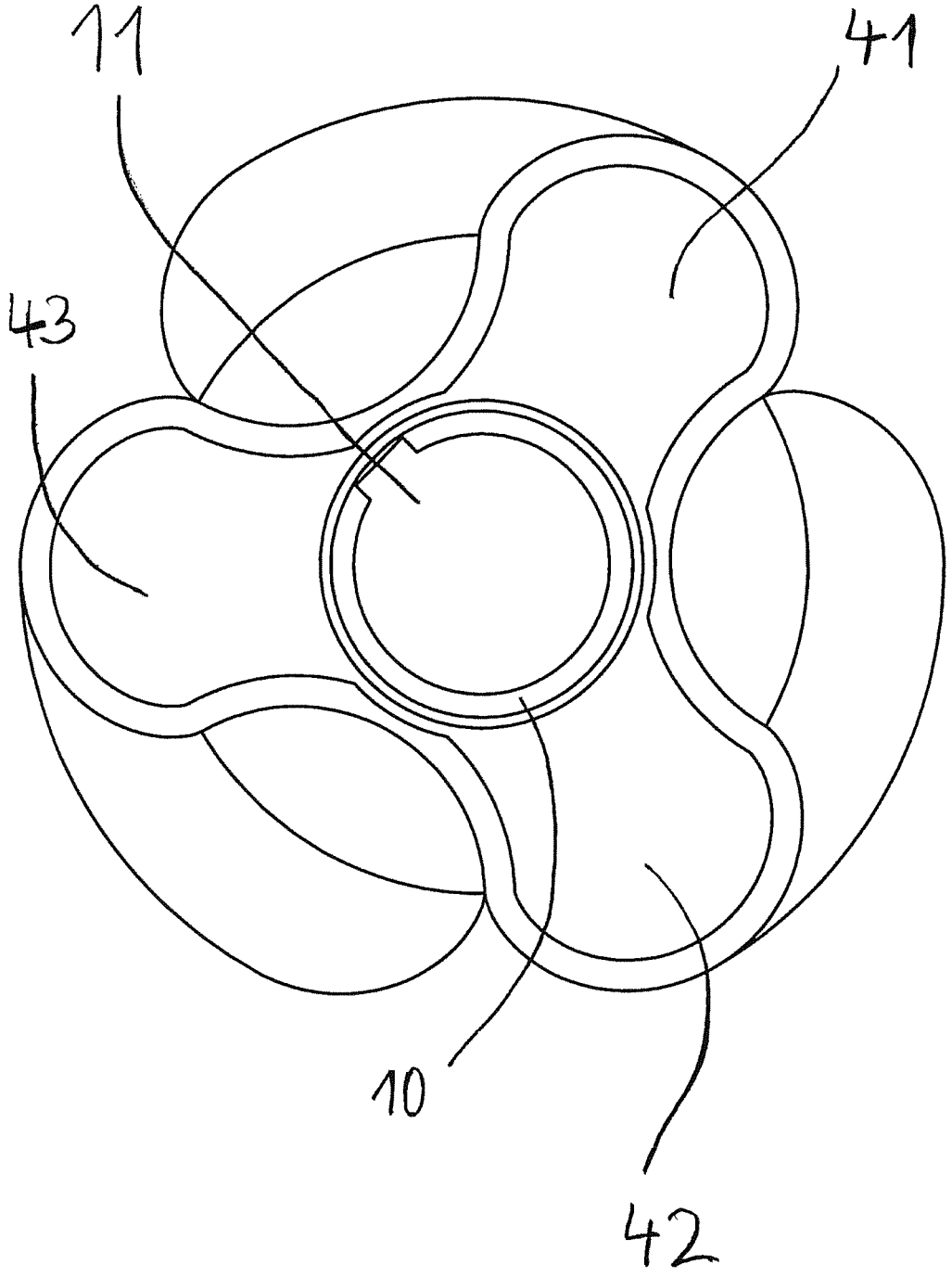
FIG. 1 is a perspective view of a rotary piston according to the invention obliquely from the front.
Figure 1A:
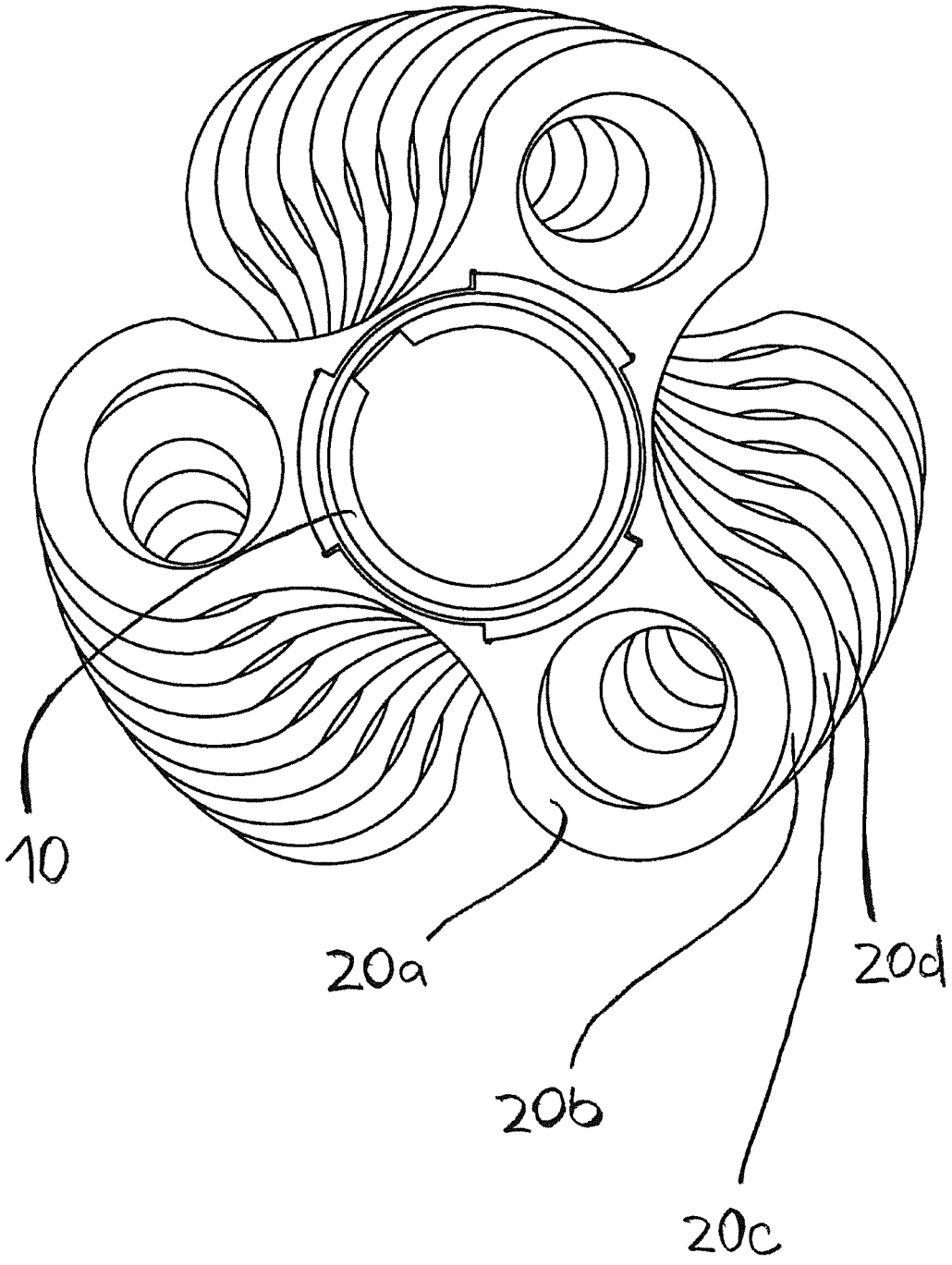
FIG. 1*a* is a view as per FIG. 1 without polymer material.

As referenced in the Figures, the same reference numerals may be used herein to refer to the same parameters and components or their similar modifications and alternatives. For purposes of description herein, the terms "upper," "lower," "right," "left," "rear," "front," "vertical," "horizontal," and derivatives thereof shall relate to the present disclosure as oriented in FIG. 1. However, it is to be understood that the present disclosure may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise. The drawings referenced herein are schematic and associated views thereof are not necessarily drawn to scale.

Figure 10:
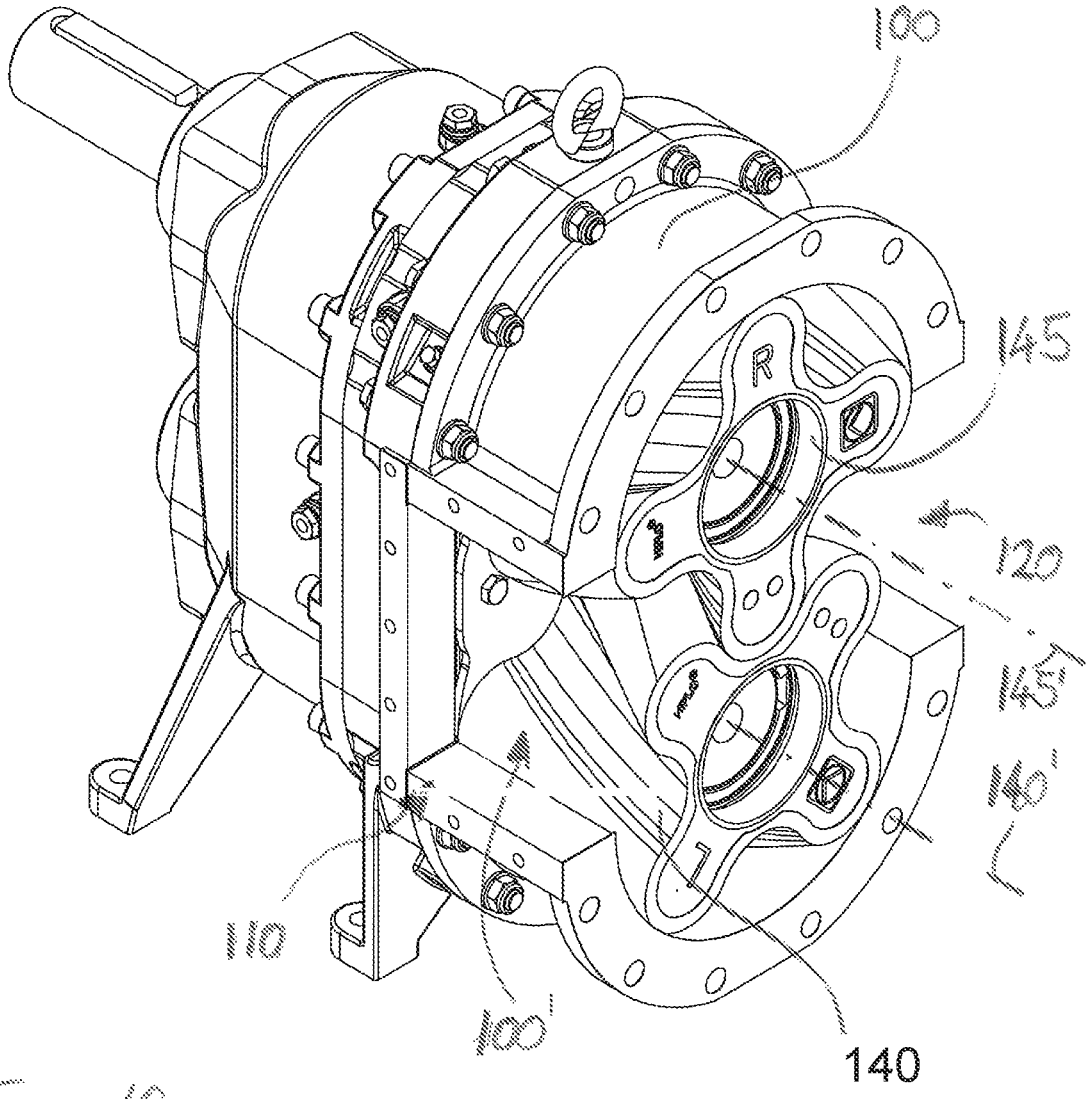
FIG. 10 is a perspective view of the pump housing.

FIG. 10 shows a rotary lobe pump with a housing 100 with first rotary piston and second rotary piston 140, 145, respectively, arranged inside said housing. The housing 100 comprises a housing interior 100'; an inlet opening 110 through which liquid can flow into the housing interior 100'; an outlet opening 120 through which liquid can flow out of the housing interior 100'; the first rotary piston 140 rotatably mounted about a first axis of rotation 140' within the housing interior 100'; and the second rotary piston 145 rotatably mounted about a second axis of rotation 145' within the housing interior 100'; wherein the first rotary piston and a second rotary piston mesh in a region between the first and the second axis 140', 145' and displace fluid.

As a preferred embodiment, a three-lobe rotary piston with twisted rotary piston lobes 41, 42, 43, which follow a helical line, is shown. It is basically to be understood that the invention is applicable to rotary pistons with straight rotary piston lobes or twisted rotary piston lobes or rotary piston lobes with a geometry that differs from these, and can be used for rotary pistons with two, three, four, five, or more rotary piston lobes.

The rotary piston according to the invention has a rotary piston hub 10 that is typically produced from a metallic material. The rotary piston hub 10 has a cylindrical inner geometry with a groove 11 for the connection fixedly in terms of torque to a drive shaft by means of a parallel key. Use may basically also be made of other shaft-hub connections which are suitable for transmitting torque from the shaft to the hub, for example, polygonal shafts, which interact with a corresponding inner geometry of a polygonal hub, conical connections which connect the shaft to the hub by means of a non-positively locking connection, toothings between shaft and hub, and the like. The rotary piston hub 10 is surrounded by three rotary piston lobes 41, 42, 43, which are arranged around the circumference of the rotary piston hub 10 with a 120° pitch, and which, in an axial direction of the rotary piston hub 10, twist through approximately 60° in the circumferential direction along a helical line. It is basically to be understood that the number of degrees of twist should be selected in a manner dependent on the number of lobes in order to achieve pulsation-free operation, a leakage-free pump action, and prevention of a backward flow through the pump in all rotational positions of the rotary pistons. Accordingly, in the case of two-lobe pistons, a twist of the lobes through 90°, in the case of three-lobe pistons, a twist of the lobes through 60°, and in the case of four-lobe pistons, a twist of the lobes through 45°, and generally a twist of the lobes through 180° divided by the number of lobes, should be adhered to or not exceeded.

The rotary piston lobes 41, 42, 43 are coated both on their flanks and at their tips and end sides with a polymer material. Said polymer material is also partially formed in the interior space of the rotary piston lobes 41, 42, 43; the exact configuration will be discussed in detail below.

As polymer material, use is preferably made of a resiliently elastic material, which may in particular be a rubber material hardened by vulcanization.

Figure 1B:
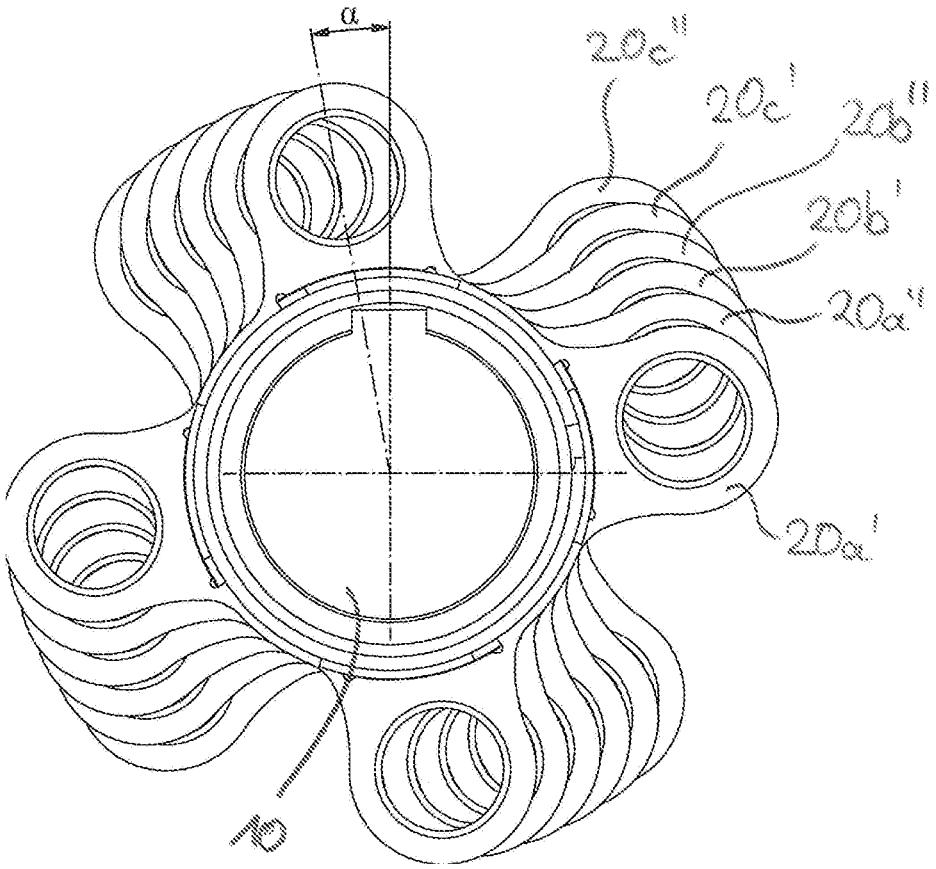
FIG. 1*b* is a view as per FIG. 1 without polymer material having two different sets of spaced-apart plates.

FIG. 1*a*, 1*b*, 2*a*, 3*a* and 4*a* show a frame structure that serves for producing a connection rigid in terms of torque between the rotary piston lobes and the rotary piston hub 10. The frame structure comprises multiple frame sheets 20*a*, 20*b*, 20*c*, 20*d*, etc., which basically correspond to the cross-sectional contour in an axial cross section of the rotary piston, but which are of smaller dimensions than the cross-sectional dimension. FIG. 1*b* shows a frontal view according to FIG. 1*a* of an embodiment having two different sets of spaced-apart plates. FIG. 1*b* shows a first set of plates 20*a*', 20*b*', 20*c*' and a second set of plates 20*a*", 20*b*", 20*c*", which are pushed onto a hub with a rectilinear, non-circular outer contour. The plates of the first set have a first geometry and the plates of the second set have a second geometry. The difference in geometry lies in the interface of the plates to the hub.

Figure 6:
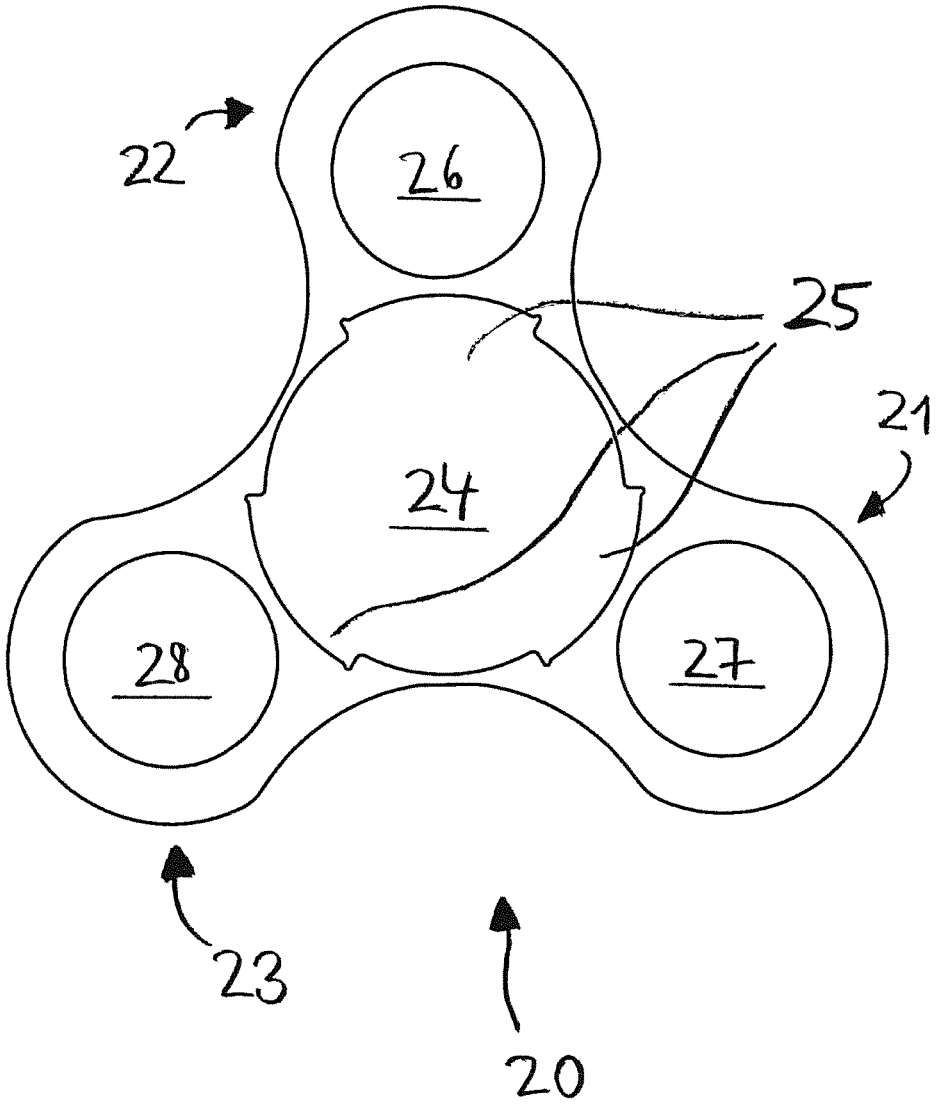
FIG. 6 is a frontal view of a frame sheet of the embodiment as per FIG. 1.
Figure 7:
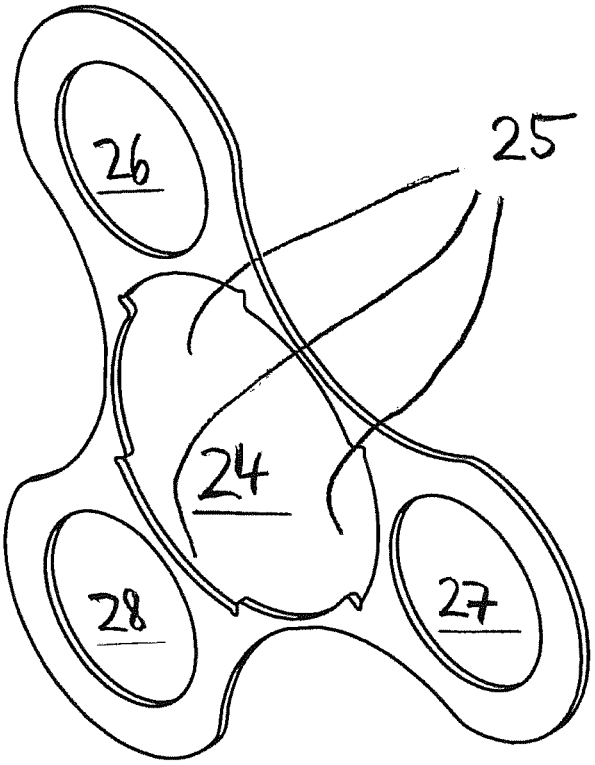
FIG. 7 is a perspective view of a frame sheet of the embodiment as per FIG. 1.

Each frame sheet consequently has three lobes 21, 22, 23, which are arranged with a pitch of 120° with respect to one another. Furthermore, each frame sheet has a central recess 24; in this regard, see FIGS. 6 and 7. Said central recess 24 is designed so as to produce a connection fixed in terms of torque between the frame sheet and the rotary piston hub 10. In the preferred embodiment, this is achieved by virtue of the recess being substantially circular and having three grooves 25 distributed over the circumference, which grooves 25 interact in positively locking fashion with three webs 12, 13, 14, which are formed congruently with respect to said grooves 25, on the outer surface of the rotary piston hub 10, as can be seen from FIG. 5. It is basically to be understood that the connection fixed in terms of torque between frame sheet and rotary piston hub may be implemented in different ways; alternatively, to the embodiment illustrated here, it is also possible for embodiments to be formed with a single groove and with a corresponding single web, and alternatively, other connection types may be implemented with a toothing or the like. In the case of the embodiment shown, the circumferential length of the grooves 25 in the frame sheet amounts to approximately 60°, giving rise to a uniform distribution of the three set-back circumferential parts and the three protruding circumferential parts of the central recess 24 in the frame sheet. Here, the groove-like recess is arranged in each case in the region of the rotary piston lobes in order to permit expedient material utilization and a slim form of the frame sheet in the region between the rotary piston lobes.

Each frame sheet furthermore has a circular recess 26, 27, 28 in each rotary piston lobe. The frame sheets of the rotary piston according to the invention are, therefore, designed so as to exhibit a maximum material saving while predefining the outer contour of the rotary piston and a connection fixed in terms of torque formed in direct contact with the rotary piston hub 10.

Figure 5:
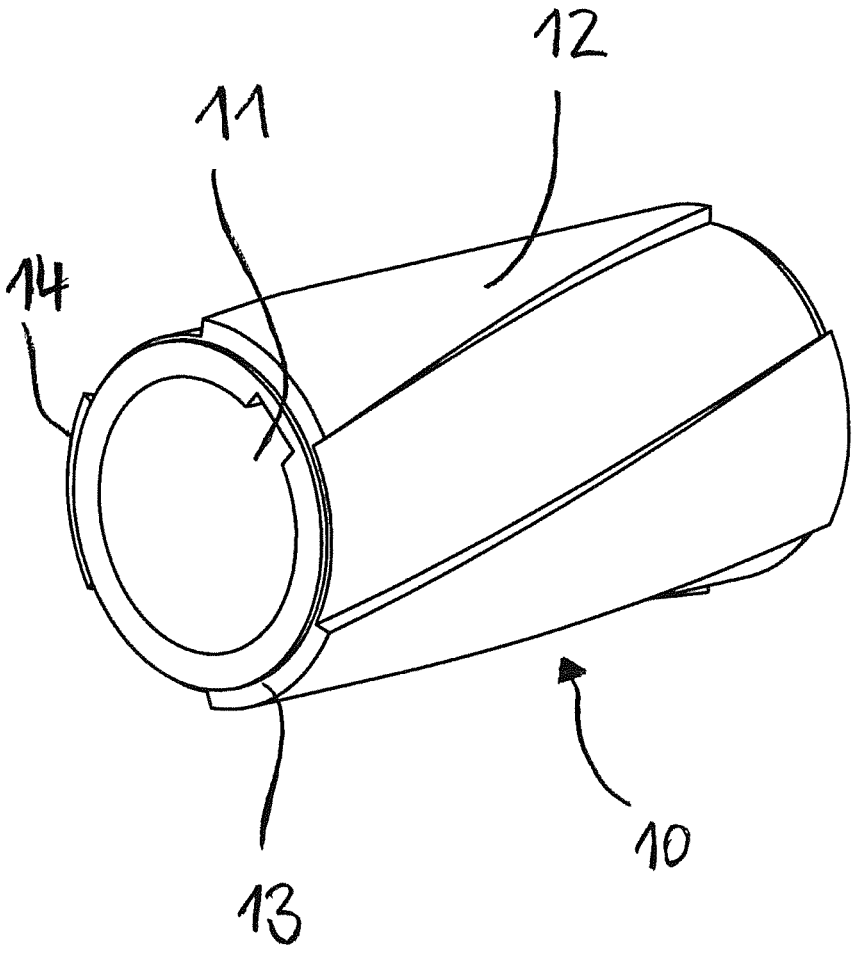
FIG. 5 is a perspective view obliquely from the side of the hub body of the embodiment as per FIG. 1*a;*

As can be seen from FIG. 5, in an axial longitudinal direction along the circumferential surface of the rotary piston hub, the webs 12, 13, 14 run along a helical line which corresponds to the helical profile of the rotary piston lobes. As a consequence of this, the inner frame of the rotary piston according to the preferred embodiment can be constructed from multiple frame sheets which are all of corresponding design. Aside from this preferred embodiment, other refinements of the rotary piston according to the invention are also conceivable and advantageous in certain applications. For example, an embodiment may also be advantageous in which the webs are formed rectilinearly in an axial longitudinal direction on the rotary piston hub. In conjunction with the frame sheets shown in FIGS. 6 and 7, this refinement yields a rotary piston with straight rotary piston lobes. Furthermore, in the case of a rotary piston hub of said type being formed with straight webs, a helical profile of the rotary piston lobes can be achieved by virtue of frame sheets of different design being used in alternation. This different design must in this case consist in that the angular offset between the grooves 25, on the one hand, and the rotary piston lobe sections 21, 22, 23, on the other hand, differs in the different embodiments of the frame sheets. Here, the angular difference arises from the desired gradient of the rotary piston lobes along the helical profile and the axial spacing of the frame sheets on the rotary piston hub 10.

Figure 2:
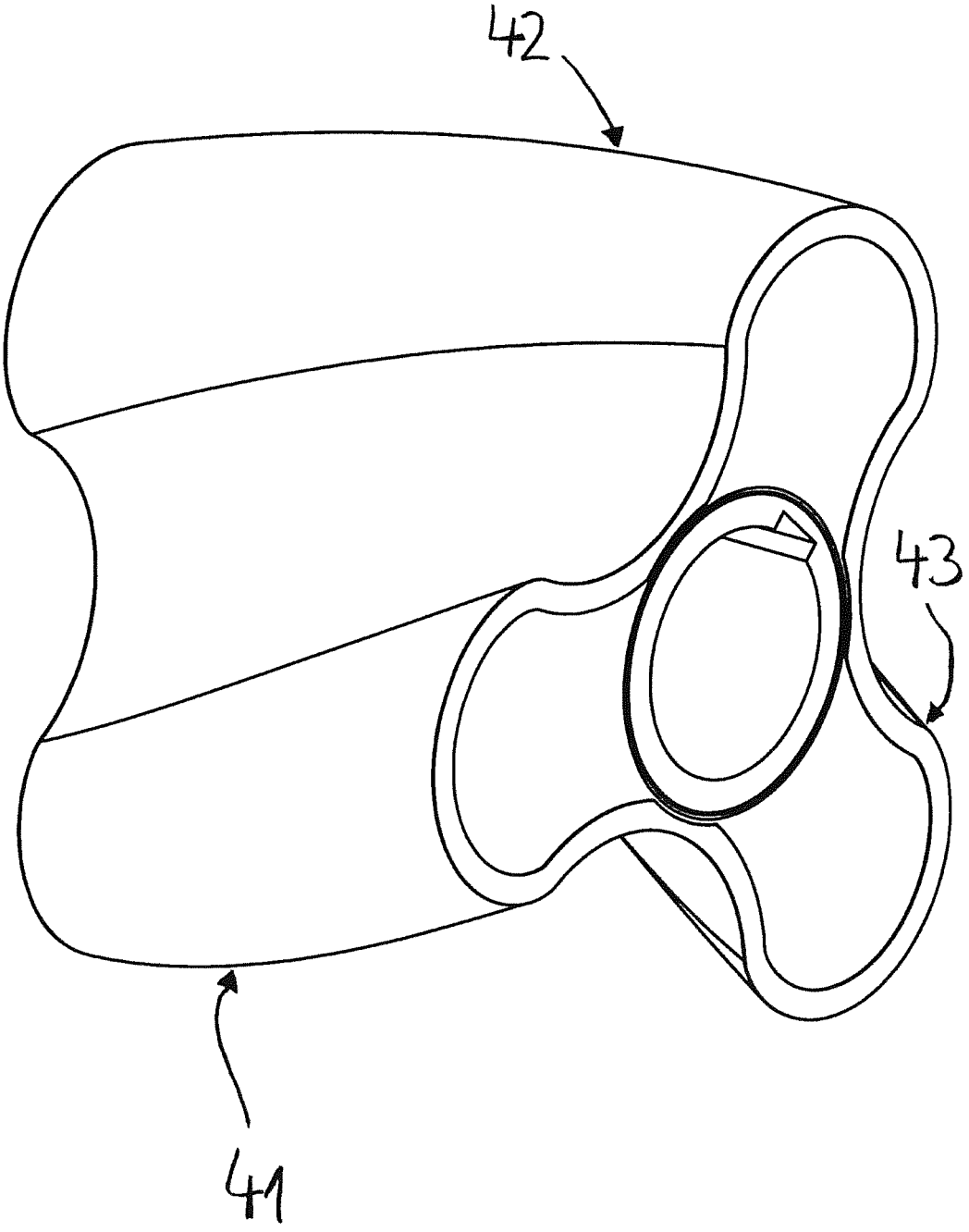
FIG. 2 is a perspective view of the embodiment as per FIG. 1 obliquely from the side.
Figure 2A:
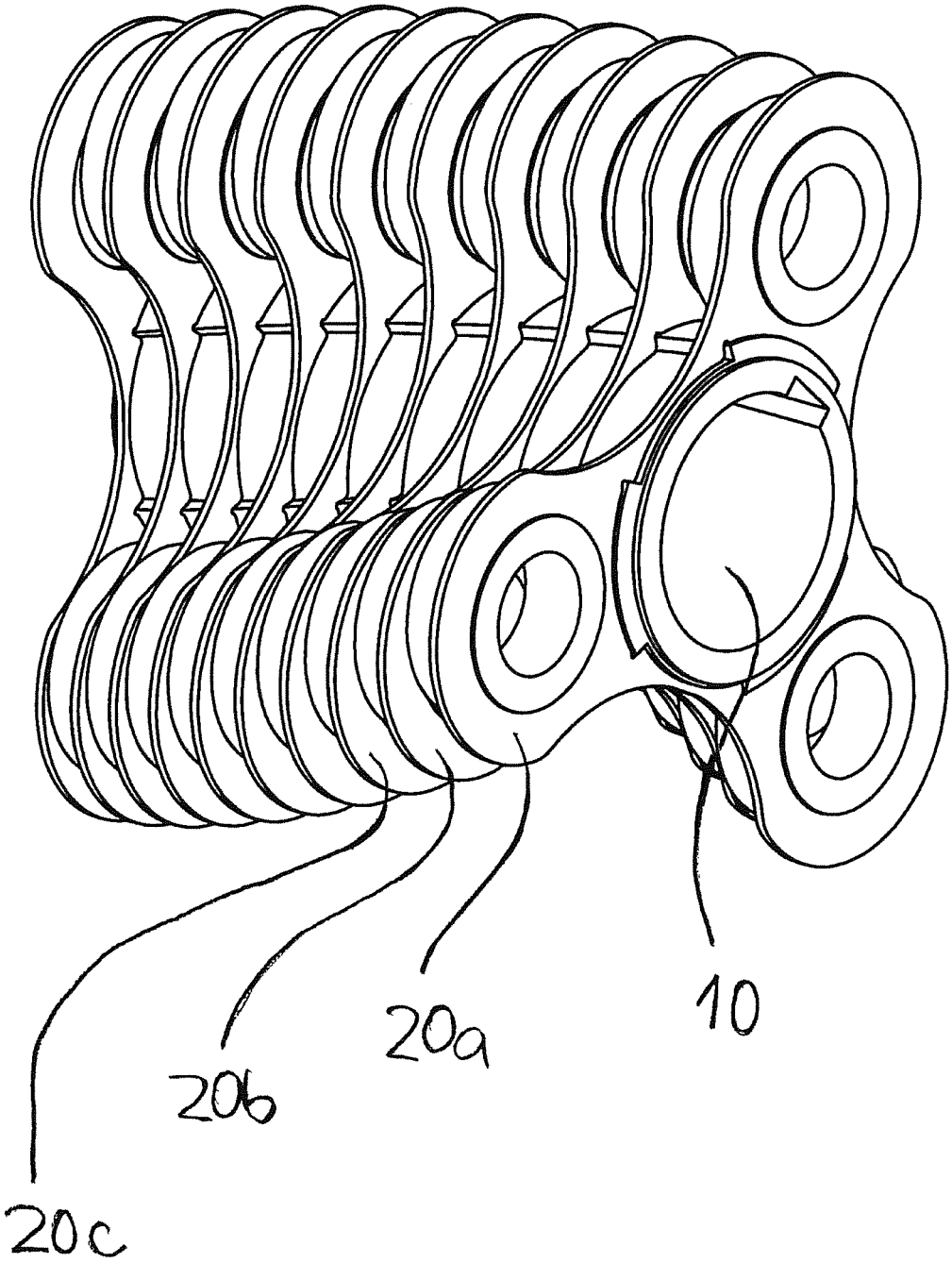
FIG. 2*a* is a view as per FIG. 2 without polymer material.
Figure 3:
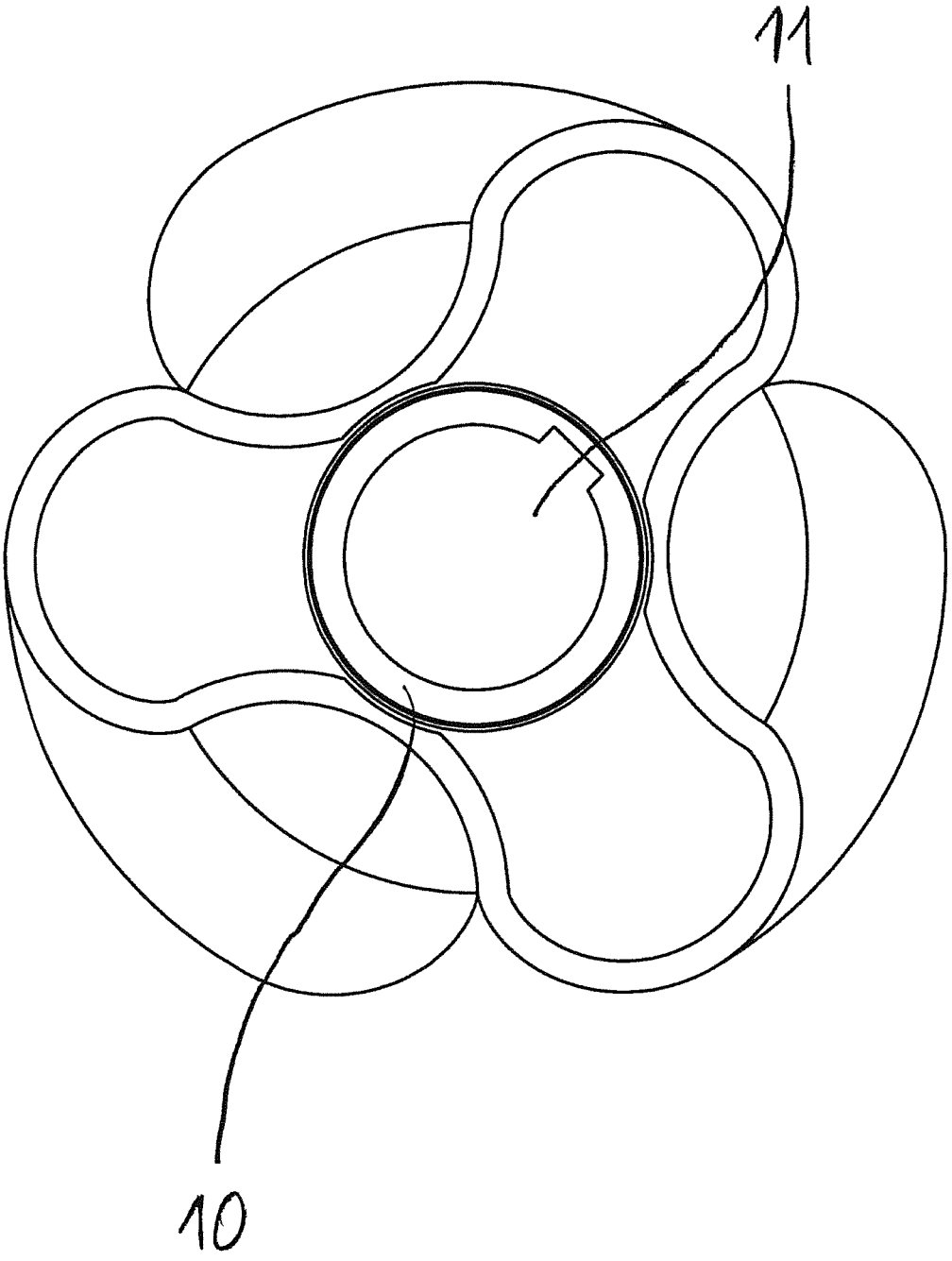
FIG. 3 is a frontal view of the embodiment as per FIG. 1.
Figure 3A:
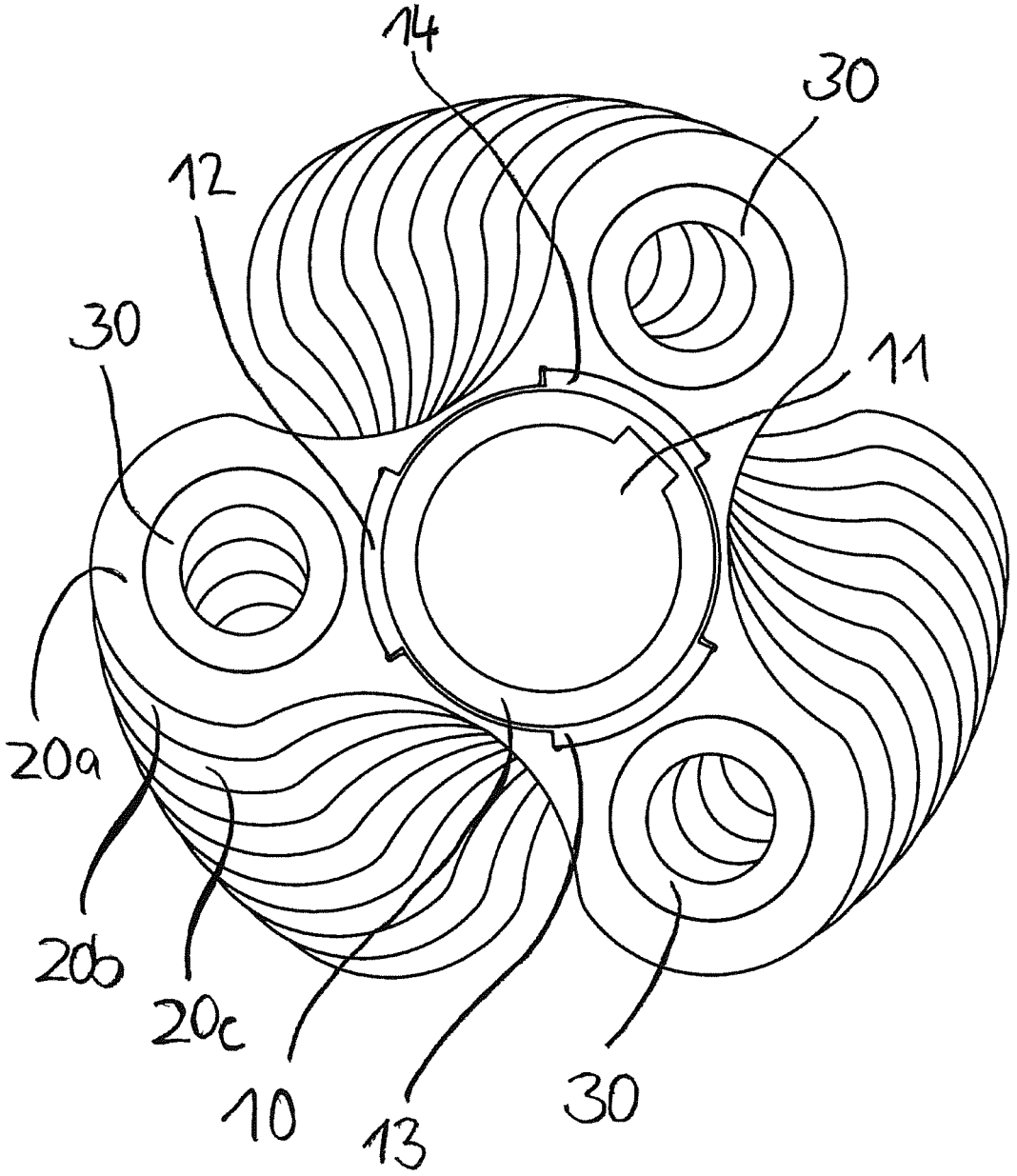
FIG. 3*a* is a view as per FIG. 3 without polymer material.
Figure 4:
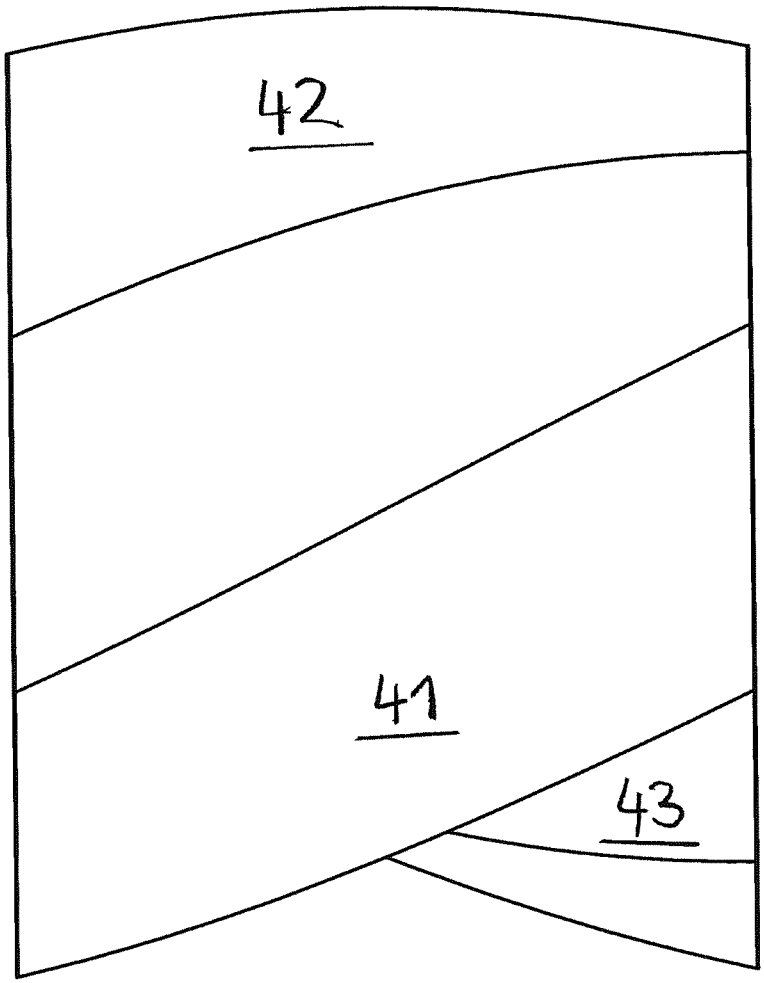
FIG. 4 is a side view of the embodiment as per FIG. 1.
Figure 4A:
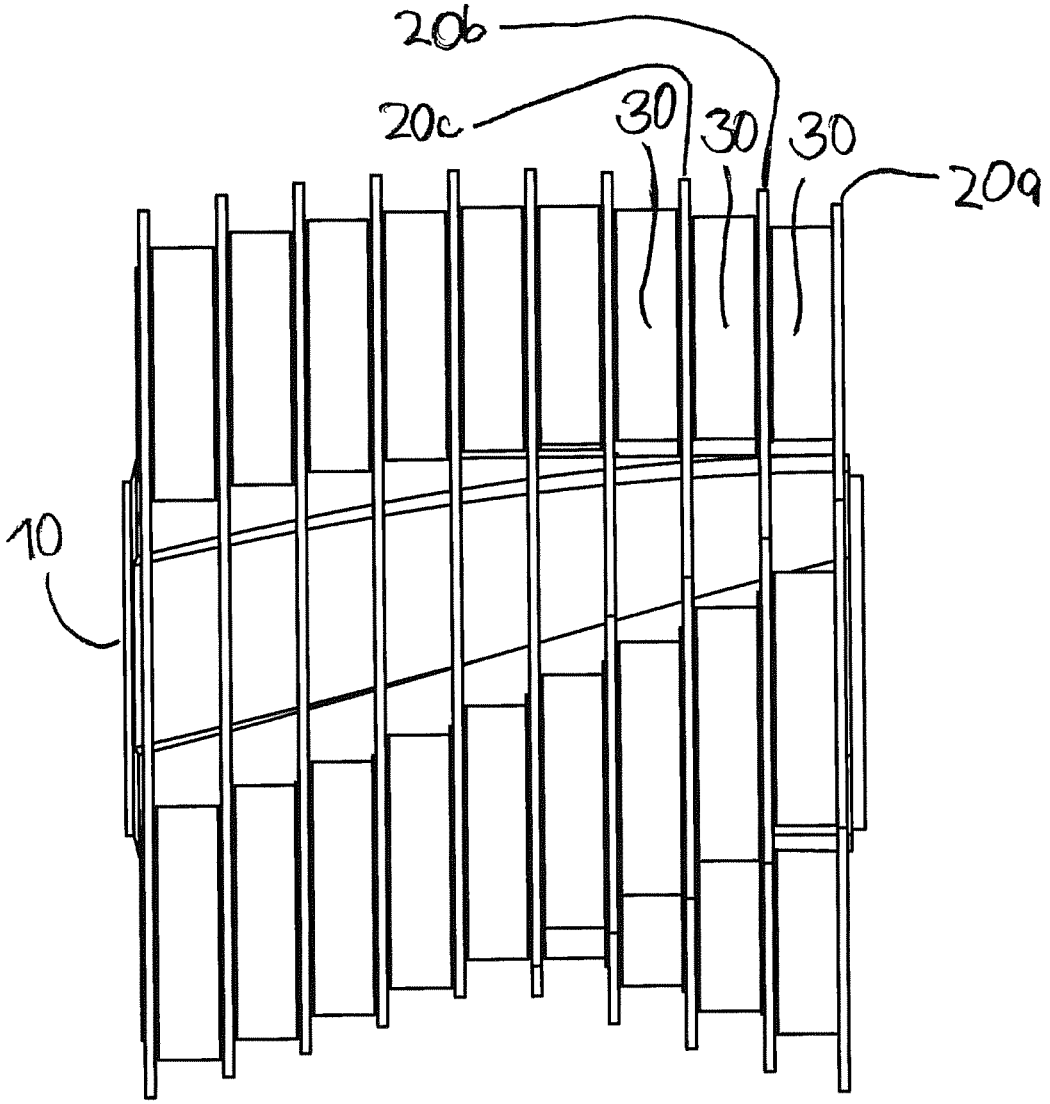
FIG. 4*a* is a view as per FIG. 4 without polymer material.

As can be clearly seen in particular from FIG. 2*a* and FIG. 4*a*, the rotary piston according to the invention is constructed from a total of ten frame sheets. These frame sheets are arranged on the rotary piston hub 10 so as to be uniformly spaced apart axially over the entire axial length of the rotary piston. In each case, two adjacent frame sheets are positioned relative to one another by means of three spacer element pieces 30 which form a spacer element. Instead of the spacer element being made up of three spacer element pieces 30, it is in some applications advantageous, for the simplification of the assembly process, for the spacer element to be produced in one piece, for example, by virtue of the three spacer element pieces 30 being connected to one another by means of webs or the like.

Figure 8:
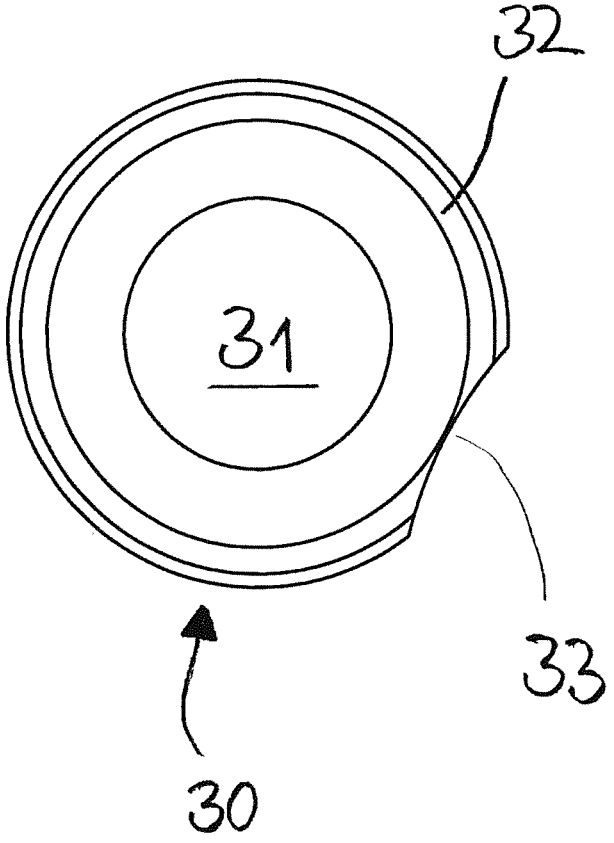
FIG. 8 is a frontal view of a spacer element of the embodiment as per FIG. 1.
Figure 9:
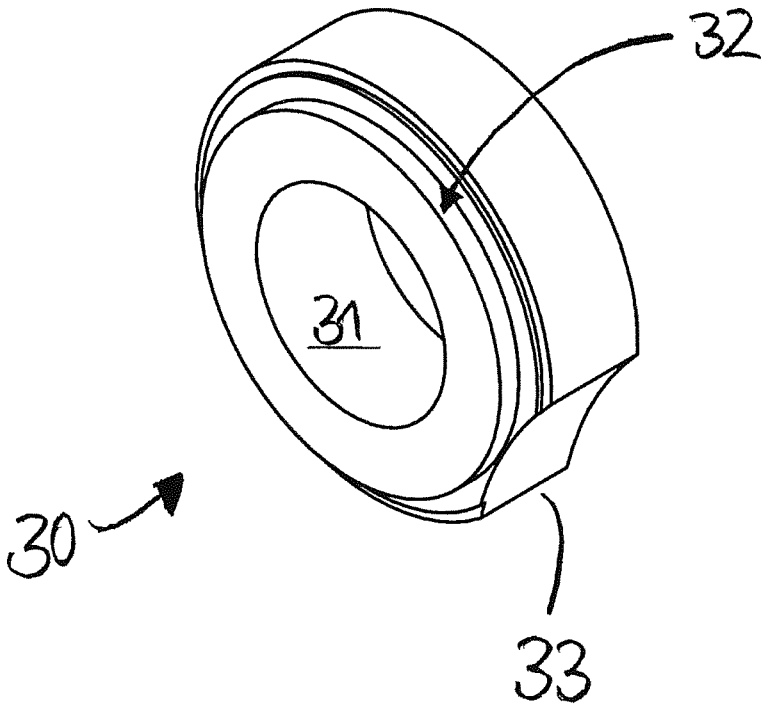
FIG. 9 is a perspective view of a spacer element of the embodiment as per FIG. 1.

A spacer element piece 30 is shown in FIGS. 8 and 9. As can be seen from these Figures, the spacer element piece 30 has a substantially ring-shaped body that has a central axial recess 31. On an end side of the spacer element piece 30, there is formed an encircling shoulder 32. The outer diameter of said shoulder 32 is slightly smaller than the inner diameter of the circular recesses 26, 27, 28 in the frame sheets, and thereby permits positive locking centered positioning of the spacer element piece 30 within said recesses. On the opposite side, the spacer element piece 30 is formed with a planar end surface. As an alternative to this, it is basically possible for a corresponding encircling shoulder, which realizes defined positioning of two adjacent frame sheets with respect to one another, to also be formed on the opposite side. In the case of the spacer element pieces being used for a rotary piston with straight rotary piston lobes, the shoulders on the two end sides may in this case be coaxial with respect to one another; in the case of the spacer element piece 30 being used for a rotary piston with a helical profile of the rotary piston lobes, the shoulders should be formed with a corresponding eccentric offset with respect to one another.

Each spacer element piece 30 furthermore has, in one circumferential section, a rounded recess 33, the radius of which corresponds to the radius of the outer surface of the rotary piston hub 10. The spacer element pieces 30 can in this way be positioned so as to lie directly on the rotary piston hub 10 and be secured against relative rotation.

A rotary piston according to the invention is constructed by means of a frame which comprises multiple frame sheets 20 and in each case three spacer element pieces 30 between two adjacent frame sheets 20. By means of this construction, a sturdy frame structure is provided which defines the contour of the rotary piston lobes and exhibits a positive locking connection to the rotary piston hub. It is to be understood that the frame sheets are preferably produced from a metallic material. The spacer element pieces 30 may preferably be produced from a polymer material.

The frame structure constructed in this way with the rotary piston hub is hereinafter filled and enveloped with the polymer material. This filling and enveloping process may, in particular, take place such that three, already-hardened, for example, vulcanized polymer strands, are pushed through the openings 26, 27, 28 of the frame sheets 20, wherein it is particularly advantageous for an elastically deformable polymer material with an outer diameter slightly smaller than the inner diameter of said openings to be used for this purpose in order that it can follow the helical profile in which said openings are staggered relative to one another. Alternatively, it is also possible for prefabricated vulcanizable polymer strands to be inserted into the openings; in this case, the vulcanization of the polymer strands takes place during the subsequent vulcanization of the coating or envelopment with the rest of the polymer material.

Following this, the frame structure thus prepared, with the prefabricated polymer fractions already inserted, can be encapsulated and enveloped with a liquid polymer material, whereby the cavities within the frame structure are completely filled. By means of the large volume fraction of the already-hardened and crosslinked polymer material, little shrinkage of the polymer material occurs during the course of the crosslinking thereof. In particular, it is also possible for two-stage encapsulation with the liquid polymer material to be performed in a time-offset manner in order, in a first encapsulation process, to realize filling up to, or up to slightly below, the outer edge of the frame sheets, and, in a subsequent second encapsulation process, to realize the complete outer contour with envelopment of the frame. The material thickness is basically dependent on the usage situation and on the overall dimensions of the rotary piston; for example, a material thickness of at least 5 mm of polymer material may be provided between the outer edges of the frame sheets and the outer contour of the rotary piston.

Owing to its construction, the rotary piston according to the invention has a rigid construction that can be subjected to high torque. At the same time, the fraction of metallic material is significantly reduced, whereby the weight of the rotary piston and the consumption of valuable starting materials are considerably reduced. The manufacture of the rotary piston is greatly simplified owing to the possible modularity with the use of identical components. Accordingly, for example, through the use of different rotary piston hubs with different gradients of the webs formed thereon or lengths, it is possible to produce rotary pistons with different gradient of the rotary piston lobes or different lengths in a modular system.

It will be understood by one having ordinary skill in the art that construction of the described present disclosure and other components is not limited to any specific material. Other exemplary embodiments of the disclosure disclosed herein may be formed from a wide variety of materials, unless described otherwise herein.

For purposes of this disclosure, the term "operably coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

For purposes of this disclosure, the term "operably connected" (in all of its forms, connect, connecting, connected, etc.) generally means that one component functions with respect to another component, even if there are other components located between the first and second component, and the term "operable" defines a functional relationship between components.

It is also important to note that the construction and arrangement of the elements of the present disclosure as shown in the exemplary embodiments is illustrative only. Although only a few embodiments of the present innovations have been described in detail in this disclosure, those skilled in the art who review this disclosure will readily appreciate that many modifications are possible, e.g., variations in sizes, dimensions, structures, shapes and proportions of the various elements, values of parameters, mounting arrangements, use of materials, colors, orientations, etc. without materially departing from the novel teachings and advantages of the subject matter recited. For example, elements shown as integrally formed may be constructed of multiple parts or elements shown in multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of the wide variety of materials that provide sufficient strength or durability, in any of the wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is to be understood that variations and modifications can be made on the aforemen-tioned structure and method without departing from the concepts of the present disclosure, and further it is to be understood that such concepts are intended to be covered by the following claims unless these claims by their language expressly state otherwise.

The invention claimed is:

1. A rotary pump, comprising:

a housing with a housing interior;

an inlet opening through which liquid can flow into the housing interior;

an outlet opening through which liquid can flow out of the housing interior;

a first rotary piston rotatably mounted about a first axis of rotation within the housing interior; and a second rotary piston rotatably mounted about a second axis of rotation within the housing interior;

wherein the first rotary piston and the second rotary piston mesh in a region between the first and the second axis and displace fluid, and the first rotary piston has a framework arrangement comprising a plurality of mutually spaced-apart plates and the framework arrangement is at least partially filled and at least partially enveloped with a polymer material;

wherein each of the plurality of mutually spaced-apart plates has the spacer element formed integrally thereon and produced by bending deformation of a portion of one of the plurality of mutually spaced-apart plates, the spacer element positioning the plurality of mutually spaced-apart plates at a predetermined spacing from one another;

wherein each of the plurality of mutually spaced-apart plates has at least one spacer element abutment surface situated at a predetermined height above and pointing away from a plane of one of the plurality of spaced-apart plates in contact with an adjacent one of the plurality of mutually spaced-apart plates; and wherein three spacer element abutment surfaces are situated at a predetermined height above and pointing away from a plane of the one of the plurality of mutually spaced-apart plates in contact with an adjacent one of the plurality of mutually spaced-apart plates.

2. The rotary piston pump as claimed in claim 1, wherein the plurality of mutually spaced-apart plates are formed from a material that differs from the polymer material.

3. The rotary piston pump as claimed in claim 2, wherein the plurality of mutually spaced-apart plates are formed from a metallic material.

4. The rotary piston pump as claimed in claim 2, wherein the polymer material is a resiliently elastic material.

5. The rotary piston pump as claimed in claim 1, wherein the plurality of mutually spaced-apart plates are oriented parallel to one another.

6. The rotary piston pump as claimed in claim 1, wherein the spacing between the plurality of mutually spaced-apart plates is equal.

7. The rotary piston pump as claimed in claim 1, wherein each spacer element abutment surface comprises a mutually aligned and mutually spaced-apart spacer element abutment surface piece, and two adjacent plates of the plurality of mutually spaced-apart plates are in direct contact with one another via the spacer element abutment surfaces.

8. The rotary piston pump as claimed in claim 1, wherein the spacer element is formed from a material which differs from the polymer material.

9. The rotary piston pump as claimed in claim 8, wherein the spacer element is formed from a material that has a coefficient of thermal expansion which is less than 75% of the coefficient of thermal expansion of the polymer material.

10. The rotary piston pump as claimed in claim 1, wherein the polymer material comprises a prefabricated polymer component inserted in a cross-linked state through mutually aligned openings in the plurality of mutually spaced-apart plates, and a polymer material fraction formed by a flowable polymer material component which, in a flowable state, at least partially envelops the plurality of spaced-apart plates and the prefabricated polymer component and is thereafter cross-linked so as to assume a solid state.

11. The rotary piston pump as claimed in claim 1, wherein a mechanical connection between the polymer material and the plurality of mutually spaced-apart plates is formed by any of:

adhesive bonding;

positive locking between the polymer material and a surface of the plurality of mutually spaced-apart plates that de-limit openings or recesses in the plurality of mutually spaced-apart plates, which openings or recesses are filled with the polymer material; or non-positively locking connection by means of clamping elements which clamp the plates and the polymer material together.

12. The rotary piston pump as claimed in claim 1, wherein the second rotary piston comprises a framework arrangement comprising a plurality of mutually spaced-apart plates, the framework arrangement being at least partially filled and at least partially enveloped with a polymer material.

13. The rotary piston pump as claimed in claim 12, wherein the first and the second rotary piston have an internally situated, non-circular opening that is not filled with the polymer material and the first and second rotary piston, respectively, are rotatably mounted by means of a first and second shaft, respectively, one of the first and second shafts being arranged in the opening.

14. The rotary piston pump as claimed in claim 1, wherein each of the first and the second rotary piston have at least two rotary piston lobes which extend in a helical line along the outer circumference of each of the first and the second rotary pistons, and the plurality of mutually spaced-apart plates have a corresponding geometry with at least two rotary piston lobes.

15. The rotary piston pump as claimed in claim 14, wherein each of the plurality of mutually spaced-apart plates are geometrically identical, and the helical profile is realized by means of a non-circular, helically running outer contour of a drive shaft or hub in a positive locking fit with a central recess of the each of the plurality of mutually spaced-apart plates.

16. The rotary piston pump as claimed in claim 14, wherein the plurality of mutually spaced-apart plates are divided into at least two sets which are pushed onto a shaft or hub with a rectilinear, non-circular outer contour, wherein the plurality of mutually spaced-apart plates within a first set have a first geometry, and the plurality of mutually spaced-apart plates within a second set have a different second geometry, such that the angular position between a non-circular contour of a central recess and the rotary piston lobe differs between the plurality of mutually spaced-apart plates of the first and second sets.

17. A method for producing a rotary piston for a rotary piston pump for conveying particle-laden liquids comprising the steps of:

forming a frame arrangement by arranging a plurality of mutually spaced-apart plates;

at least partially enveloping the frame arrangement with a polymer material in a flowable state; and connecting the frame arrangement to the polymer material by crosslinking the polymer material;

wherein two of the plurality of mutually spaced-apart plates are positioned so as to be mutually spaced apart and parallel to one another by means of at least one of a plurality of spacer elements and which have abutment surfaces for two adjacent plates of the plurality of mutually spaced-apart plates; and wherein each of the plurality of mutually spaced-apart plates has a one of the plurality of the spacer elements formed integrally thereon and produced by bending deformation of a portion of one of the plurality of mutually spaced-apart plates.

18. The method as claimed in claim 17, wherein the frame arrangement comprises the plurality of mutually spaced-apart plates, before being at least partially enveloped with the polymer material, being positioned parallel to and spaced apart from one another by means of the plurality of spacer elements, whereby the spacer elements are enveloped with the polymer material and form part of the rotary piston.

19. The method as claimed in claim 17, wherein the step of at least partial enveloping the plurality of mutually spaced-apart plates with the polymer material is performed according to a method comprising the additional steps of:

filling a first fraction of the polymer material in a flowable state into a cavity of a casting mold in which the frame arrangement is arranged;

cross-linking the fraction of the polymer material; and at least partially enveloping the frame arrangement and the cross-linked first fraction of the polymer material with a second fraction of the flowable polymer material by filling the second fraction of the polymer material in a flowable state into the cavity of the casting mold in which the frame arrangement and the cross-linked first fraction of the polymer material are arranged.

20. The method as claimed in claim 17, wherein, before the plurality of mutually spaced-apart plates are at least partially enveloped with the polymer material, the plurality of mutually spaced-apart plates are wetted with a primer solution either individually or after arrangement as the frame assembly.

21. The method as claimed in claim 17, wherein two of the plurality of mutually spaced-apart plates are positioned so as to be mutually spaced apart and parallel to one another by means of at least one of the plurality of spacer element pieces which are formed on the plurality of mutually spaced-apart plates by bending.

22. A method for producing a rotary piston for a rotary piston pump for conveying particle-laden liquids comprising the steps of:

forming a frame arrangement by arranging a plurality of mutually spaced-apart plates;

at least partially enveloping the frame arrangement with a polymer material in a flowable state; and connecting the frame arrangement to the polymer material by crosslinking the polymer material;

wherein the polymer material is produced by the steps of:

prefabricating a block polymer component by crosslinking a prefabrication fraction of the polymer material before the formation of the frame arrangement;

arranging the block polymer component in openings or recesses in the plurality of mutually spaced-apart plates;

arranging the plurality of mutually spaced-apart plates and the block polymer component in a cavity of a casting mold;

at least partially enveloping the plates and the block polymer component with a flowable fraction of the polymer material in the state of a flowable polymer material by virtue of the flowable polymer material being filled into the cavity of the casting mold; and crosslinking the flow fraction of the polymer material such that it assumes a solid state in the cavity of the casting mold.

23. A rotary piston for a rotary piston pump for conveying particle-laden liquids comprising a frame arrangement which comprises multiple mutually spaced-apart plates, wherein the frame arrangement is at least partially filled and at least partially enveloped with a polymer material;

wherein each of the plurality of mutually spaced-apart plates has a spacer element formed integrally thereon and produced by bending deformation of a portion of one of the plurality of mutually spaced-apart plates, the spacer element positioning the plurality of mutually spaced-apart plates at a predetermined spacing from one another;

wherein each of the plurality of mutually spaced-apart plates has at least one spacer element abutment surface situated at a predetermined height above and pointing away from a plane of one of the plurality of spaced-apart plates in contact with an adjacent one of the plurality of mutually spaced-apart plates; and wherein three spacer element abutment surfaces are situated at a predetermined height above and pointing away from a plane of the one of the plurality of mutually spaced-apart plates in contact with an adjacent one of the plurality of mutually spaced-apart plates.

24. The rotary piston as claimed in claim 23, wherein the rotary piston is produced in accordance with a method comprising the steps of:

forming a frame arrangement by assembling the plurality of mutually spaced-apart plates;

at least partially enveloping the frame arrangement with a polymer material in a flowable state; and connecting the frame arrangement to the polymer material by crosslinking the polymer material.

25. A rotary pump, comprising:

a housing with a housing interior;

an inlet opening through which liquid can flow into the housing interior;

an outlet opening through which liquid can flow out of the housing interior;

a first rotary piston rotatably mounted about a first axis of rotation within the housing interior; and a second rotary piston rotatably mounted about a second axis of rotation within the housing interior;

wherein the first rotary piston and the second rotary piston mesh in a region between the first and the second axis and displace fluid, and the first rotary piston has a framework arrangement comprising a plurality of mutually spaced-apart plates and the framework arrangement is at least partially filled and at least partially enveloped with a polymer material;

wherein each of the plurality of mutually spaced-apart plates has one of a plurality of spacer elements formed integrally thereon, each of the plurality of spacer elements positioning the plurality of mutually spaced-apart plates at a predetermined spacing from one another;

wherein each of the plurality of mutually spaced-apart plates has at least one spacer element abutment surface situated at a predetermined height above and pointing away from a plane of one of the plurality of spaced-apart plates in contact with an adjacent one of the plurality of mutually spaced-apart plates;

wherein each of the first and the second rotary piston have at least two rotary piston lobes which extend in a helical line along the outer circumference of each of the first and the second rotary pistons, and the plurality of mutually spaced-apart plates have a corresponding geometry with at least two rotary piston lobes; and wherein each of the plurality of mutually spaced-apart plates are geometrically identical, and the helical profile is realized by means of a non-circular, helically running outer contour of a drive shaft or hub in a positive locking fit with a central recess of the each of the plurality of mutually spaced-apart plates.

26. A rotary pump, comprising:

a housing with a housing interior;

an inlet opening through which liquid can flow into the housing interior;

an outlet opening through which liquid can flow out of the housing interior;

a first rotary piston rotatably mounted about a first axis of rotation within the housing interior; and a second rotary piston rotatably mounted about a second axis of rotation within the housing interior;

wherein the first rotary piston and the second rotary piston mesh in a region between the first and the second axis and displace fluid, and the first rotary piston has a framework arrangement comprising a plurality of mutually spaced-apart plates and the framework arrangement is at least partially filled and at least partially enveloped with a polymer material;

wherein each of the plurality of mutually spaced-apart plates has one of a plurality of spacer elements formed integrally thereon, each of the plurality of spacer elements positioning the plurality of mutually spaced-apart plates at a predetermined spacing from one another;

wherein each of the plurality of mutually spaced-apart plates has at least one spacer element abutment surface situated at a predetermined height above and pointing away from a plane of one of the plurality of spaced-apart plates in contact with an adjacent one of the plurality of mutually spaced-apart plates; and wherein the rotary piston has a plurality of rotary piston lobes which extend in a helical line along the outer circumference of the rotary piston, and the plurality of mutually spaced-apart plates have a corresponding geometry with a plurality of rotary piston lobes, each of the plurality of rotary piston lobes of the plurality of mutually spaced-apart plates having one of the plurality of spacer elements formed integrally thereon defining the spacer element abutment surface on each of the plurality of rotary piston lobes at a predetermined and equal radial distance from the axis of the rotary piston and proximate a distal end of each of the plurality of spaced apart plates and at predetermined height above and pointing away from a plane of the one of the plurality of mutually spaced-apart plates in contact with an adjacent one of the plurality of mutually spaced-apart plates.

27. The rotary piston pump as claimed in claim 26, wherein three spacer element abutment surfaces are situated at a predetermined height above and pointing away from a plane of the one of the plurality of mutually spaced-apart plates in contact with an adjacent one of the plurality of mutually spaced-apart plates.

28. The rotary piston pump as claimed in claim 26, wherein the plurality of spacer elements are produced by bending deformation of a portion of one of the plurality of mutually spaced-apart plates.

* * * * *